United States Patent [19]

Spurling

[11] 4,162,857

[45] Jul. 31, 1979

[54] APPARATUS FOR STIRRING GRAIN

[75] Inventor: Gary A. Spurling, Taylorville, Ill.

[73] Assignee: Specialized Products, Inc., Taylorville, Ill.

[21] Appl. No.: 859,322

[22] Filed: Dec. 12, 1977

[51] Int. Cl.[2] ..... B01F 7/24; B01F 7/30

[52] U.S. Cl. ..... 366/261; 366/287

[58] Field of Search ..... 366/261, 287

[56] References Cited

U.S. PATENT DOCUMENTS

| | | | |
|---|---|---|---|
| 3,445,091 | 5/1969 | Jackson | 366/261 |
| 3,584,842 | 6/1971 | Sukup | 366/261 |
| 3,592,447 | 7/1971 | Steffen | 366/287 X |
| 3,776,512 | 12/1973 | McKinnon | 366/261 |

FOREIGN PATENT DOCUMENTS

| | | | |
|---|---|---|---|
| 2259639 | 8/1975 | France | 366/261 |

*Primary Examiner*—Philip R. Coe

*Attorney, Agent, or Firm*—Koenig, Senniger, Powers and Leavitt

[57] ABSTRACT

Apparatus for stirring a mass of grain stored in a bin, the bin having a cylindrical wall, a roof and a track extending in a circle around the inside of the wall in a horizontal plane above the level of the grain in the bin. The apparatus comprises a beam swingable in a generally horizontal plane above the grain about the central vertical axis of the bin. The inner end of the beam is suspended from the roof of the bin and the outer end has a carriage removably mounted thereon having wheels adapted to be driven along the track for effecting a sweep of the beam around the bin. A plurality of augers spaced at intervals along the length of the beam and extending downwardly therefrom are rotatable on their axes for moving the grain upward so that during a sweep of the beam around the bin the grain is stirred, aerated and blended for controlling moisture variation in the grain from bottom to top.

18 Claims, 12 Drawing Figures

DIRECTION OF TRAVEL

APPARATUS FOR STIRRING GRAIN

BACKGROUND OF THE INVENTION

This invention relates generally to apparatus for stirring grain, and more particularly to apparatus for stirring a mass of grain in a storage bin, the apparatus being generally of the type comprising a sweep arm disposed in a horizontal plane above the grain for being rotatably driven about the central vertical axis of the bin by a carriage on the outer end of the sweep arm engageable with a track extending around the inside of the bin wall, and a plurality of rotatable augers carried by the sweep arm and extending downwardly therefrom for stirring the grain in the bin thereby to aerate the grain to dry and blend it throughout the mass from bottom to top.

Reference may be made to applicant's U.S. Pat. No. 3,776,512 which shows prior apparatus for stirring grain on which the present invention is an improvement. Although the apparatus shown in that patent has been generally satisfactory, some problems have arisen, such as servicing the carriage at the outer end of the sweep arm (especially when the grain is stored in the bin), and the tendency of the carriage to jump off the track during the stirring process. The fact that the drive means for the vertical augers on the sweep arm has been largely exposed has also created certain safety problems.

SUMMARY OF THE INVENTION

Among the several objects of this invention may be noted the provision of improved apparatus of the type described above for stirring a mass of grain in a storage bin by utilizing a vertical stirring action allowing columns of heated air to pass from the bottom of the bin upward entirely through the mass of grain and effecting a gentle blending of the grain, without damage to the grain, for controlling moisture variation in the mass of grain from bottom to top and functioning to remove moisture from the grain evenly and relatively quickly, the provision of such apparatus of improved construction such as to facilitate servicing the carriage at the outer end of the sweep arm; the provision of such apparatus wherein the carriage is held on the track during rotation of the sweep arm around the bin to prevent the carriage from jumping off the track; the provision of such apparatus wherein the aforesaid auger drive means is enclosed for increased safety; the provision of such apparatus which is adjustable to fit in bins of different diameters; and the provision of such apparatus which is economical to install, and reliable and economical in operation.

In general, apparatus of this invention is adapted to stir a mass of grain stored in a bin, the bin having a cylindrical wall, a roof and a track extending in a circle around the inside of the wall in a generally horizontal plane above the level of grain in the bin. The track is mounted on supports spaced at intervals around the inside of the wall. The apparatus comprises a beam (the sweep arm), and means for mounting the beam for swinging in a generally horizontal plane above the grain about the central vertical axis of the bin. This beam mounting means comprises means for suspending the inner end of the beam from the roof of the bin and providing a pivot for the beam to swing around the bin generally on its aforesaid central vertical axis, a carriage at the outer end of the beam, and wheels on the carriage adapted to roll on the track. An electric motor is carried by the carriage and a drive from this motor to at least one of the carriage wheels is adapted to drive the carriage around the track thereby to swing the beam around the central vertical axis of the bin. A plurality of augers carried by the beam extend down from the beam at spaced intervals along the length of the beam, a plurality of bearing means, one for each auger, being mounted on one side of the beam, the upper ends of the augers extending up above the top of the beam. A second electric motor is carried by the beam at a location between the ends of the beam and is connected to the upper ends of the augers for driving the latter.

In accordance with this invention, a retainer for the carriage is provided, this retainer being carried by the beam and spaced outwardly from the outer end of the beam. The carriage comprises an elongate body extending transversely with respect to the beam between the outer end thereof and the retainer. A pin is mounted at the outer end of the beam for sliding movement axially of the pin and in the direction of the length of the beam from an extended position in which it extends out from the end of the beam through the carriage and into a hole in the retainer, to a retracted position in which the pin is retracted from the carriage for removal of the carriage from the beam.

Further in accordance with this invention, means is provided for holding the carriage wheels down on the track to prevent the carriage from jumping off the track; improved track supports are provided; cover is provided for the auger drive means; and the beam is adjustable to fit in bins of different diameters.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
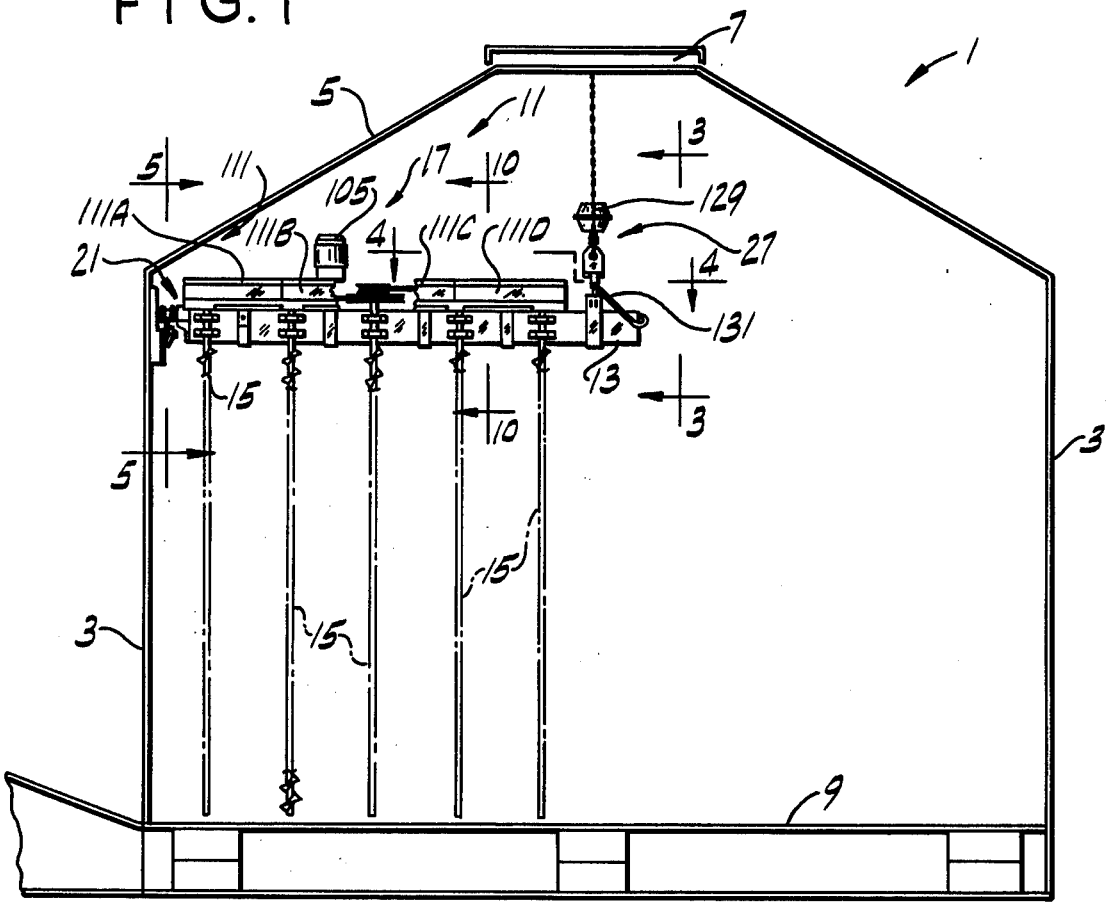
FIG. 1 is a section of a bin for storing and drying grain having mounted therein a stirring apparatus of this invention, part of a cover of the apparatus being broken away for illustrating details.

Referring to FIG. 1 of the drawings, there is indicated generally at 1 a circular bin for storage of grain, the cylindrical wall of the bin being designated 3 and its roof being designated 5. The roof, as illustrated, is conical with a central opening 7 through which grain is delivered to fill the bin generally to a level below the top of the cylindrical wall 3. The bin has a foraminous floor 9. Hot air is blown into the space or plenum under this floor and blows up through the grain body to dry it. At 11 is generally indicated apparatus of this invention for stirring the grain, involving lifting and loosening it, to expedite the aeration of the grain and to blend it.

The stirring apparatus 11 comprises a sweep arm or beam 13 disposed in a generally horizontal plane above the grain and adapted for rotation about the central vertical axis of the bin 1, and a plurality of augers (e.g., five), each designated 15, carried by the beam 13 at spaced intervals along the length of the beam. The augers extend down from the beam with their lower ends adjacent the floor 9. The stirring apparatus further comprises means indicated generally at 17 carried atop the beam for rotating the augers and means indicated generally at 21 at the outer end of the beam for moving it around the vertical axis of the bin 1.

Figure 3:
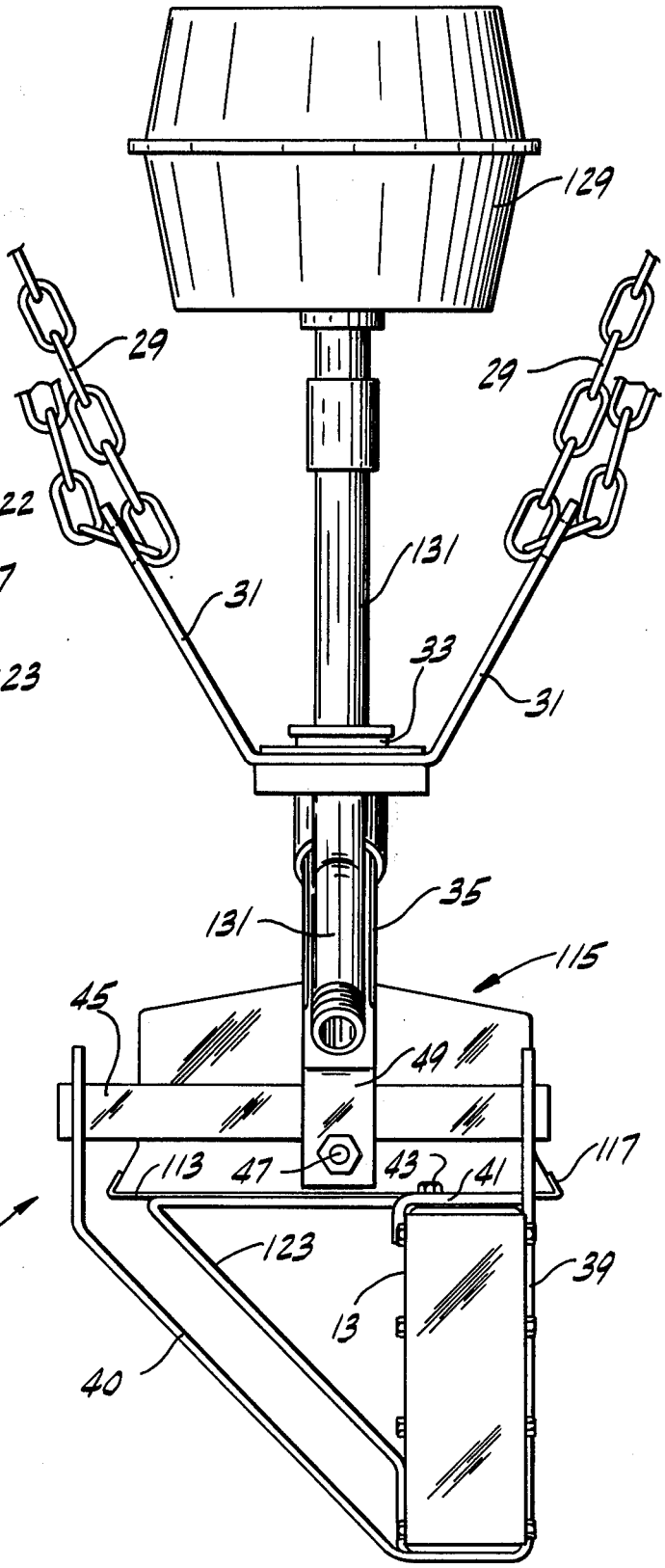
FIG. 3 is an enlarged view on line 3—3 of FIG. 1.
Figure 10:
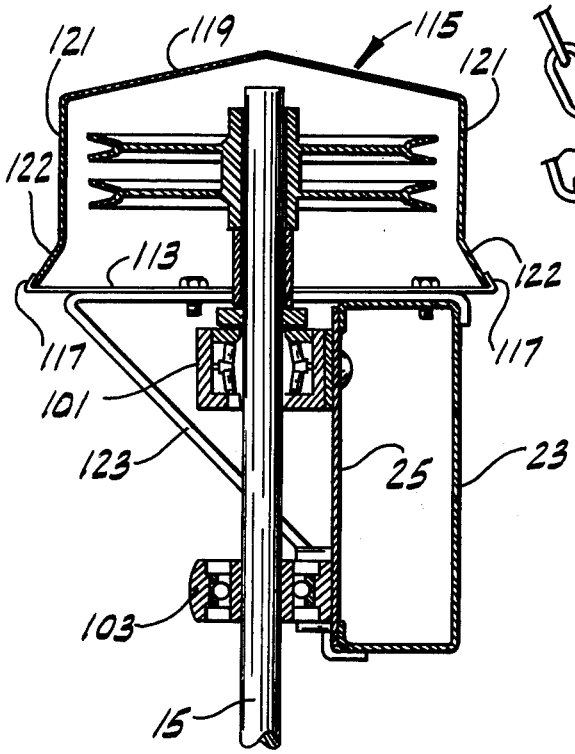
FIG. 10 is a vertical section taken along line 10—10 of FIG. 1.

The beam 13 is a hollow box-beam constituted by a channel 23 and a face plate 25 removably secured (as by self-tapping screws) to the channel at the open side thereof as shown in FIG. 10. The inner end (the right end as viewed in FIG. 1) of the beam 13 is suspended from the roof 5 of the bin by means generally indicated at 27 which is shown in FIGS. 1 and 3 to comprise a pair of chains 29 and a double-arm connector 31, the latter carrying a bearing 33 on the central vertical axis of the bin. An elongate center pivot bar 35 rotatably mounted in the bearing 33 extends downwardly therefrom and carries a hanger, generally indicated at 37, at its lower end for supporting the inner end of the beam above the grain in the bin. As viewed in FIG. 3, this hanger 37 comprises a cradle having a vertical right leg 39 and a left leg 40 sloping generally upwardly and away from the vertical leg. The beam bears on the bottom of the cradle and is disposed against the inside of the leg 39 of the cradle. An L-shaped member 41 extending laterally from the vertical right leg 39 of the cradle overlies the top of the beam 13 and constitutes a guideway for axial adjustment of the beam with respect to the hanger. Thus, the extension of the beam radially outwardly from the hanger 37 can be varied by sliding the beam on the hanger thereby to adjust the stirring apparatus 11 to fit bins of any diameter within a certain range. The beam 13 is secured in its adjusted position to the hanger 37 by self-tapping screws or the like as indicated at 43.

The hanger further includes a pair of parallel bar members 45 extending horizontally between the legs 39, 40 of the cradle above the beam 13 and generally transversely of the beam. The center pivot bar 35 extends down between these members 45 and carries at its lower end a bolt 47 on which the members 45 bear for supporting the hanger 37 above the grain in the bin. Two clamping plates, each designated 49, on the bolt at opposite sides of the members 45 provide means for rigidly securing together the pivot bar 35 and the two members. Relative adjustment of the hanger 37 and beam 13 thereon transversely with respect to the beam for balancing the beam and hanger on the bolt 47 is readily accomplished by loosening the clamping plates 49, sliding the hanger and beam thereon relative to the pivot bar 35 to a position in which the beam is balanced on the bolt, and then tightening the clamping plates for resecuring the hanger 37 and pivot bar 35 rigidly together.

Figure 5:
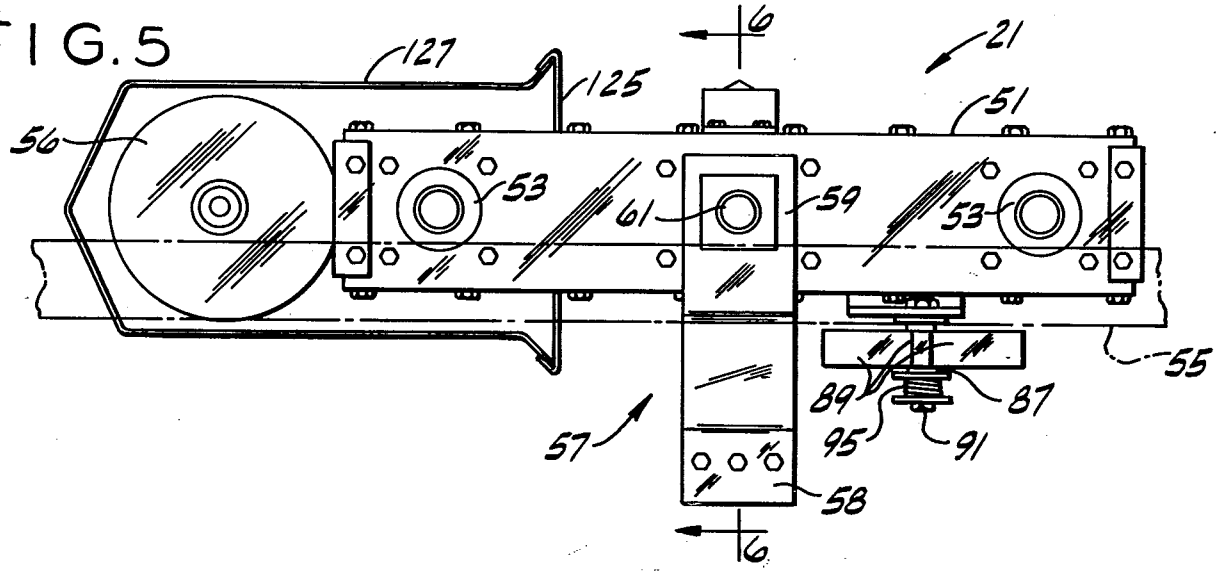
FIG. 5 is an enlarged view on line 5—5 of FIG. 1 showing a drive means for rotating the stirring apparatus around the bin.

Indicated generally at 21 in FIGS. 1 and 5 is means for effecting sweeping movement of the beam or sweep arm 13 around the vertical axis of the bin. This means comprises a carriage 51 comprising an elongate body mounted at the outer end of the beam and extending transversly with respect to the beam, having a pair of wheels, each designated 53, for rolling on a circular track 55 extending around the inside of the bin wall 3. An electric motor 56 is carried by the carriage and a drive (not shown) from the motor to at least one of the wheels 53 constitutes means for driving the carriage around the track 55 thereby to swing the beam around the central vertical axis of the bin.

Figure 6:
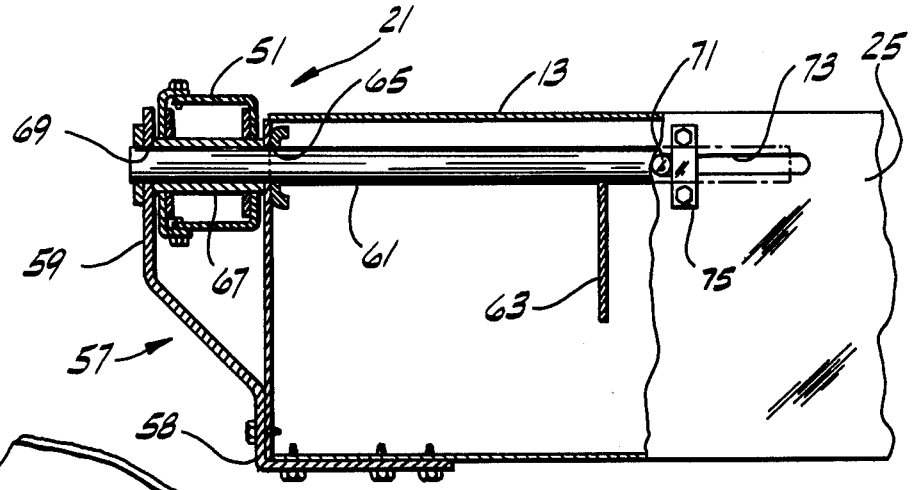
FIG. 6 is a vertical section on line6—6 of FIG. 5.

In accordance with this invention, the carriage 51 is removably mounted on the beam between the outer end of the beam and a retainer, indicated generally at 57, which has a portion 58 extending out from the outer end of the beam and an upwardly extending outboard portion 59. As shown best in FIG. 6, a pin 61 mounted inside the beam on a support 63 extends out from the end of the beam through a hole 65 therein and is slidable in the direction of the length of the beam from an extended position (shown in solid lines) in which it extends out from the end of the beam through a sleeve 67 in the carriage 51 and into a hole 69 in the outboard portion 59 of the retainer 57, to a retracted position (shown in phantom) in which the pin is retracted from the carriage for removal of the carriage from the beam. For sliding the pin 61 between its extended and retracted positions, a crossbar 71 at the inner (right) end of the pin extends out of the beam through a slot 73 in the face plate 25 of the beam. This crossbar 71 is adapted to be locked in position at the left end of the slot by suitable means such as a retaining strap indicated at 75. Thus, the pin 61 can be held in its extended position thereby securely to mount the carriage 51 on the beam. Removal of the carriage from the beam (as during servicing of the carriage) is readily accomplished by moving the retaining strap 75 to a position in which it does not block the crossbar 71 and then sliding the latter to the right in the slot 73 until the pin 61 reaches its retracted position in which it is withdrawn from the carriage.

Figure 7:
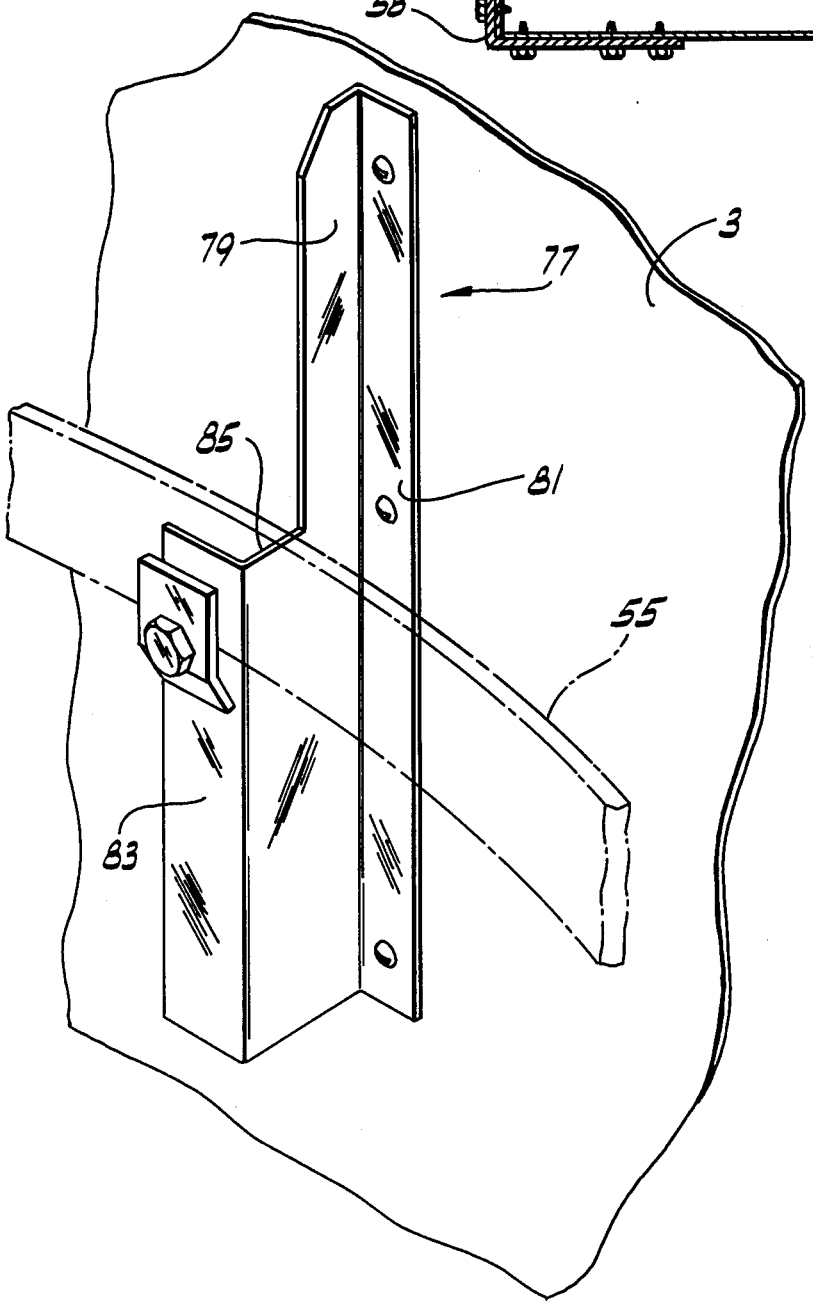
FIG. 7 is a perspective of a track support on the bin wall.

The track 55 is supported by a plurality of track supports, each generally indicated at 77, spaced at regular intervals around the inside of the bin wall 3. More particularly, each support 77 comprises a vertical Z-bar having a web 79, a first side flange 81 secured to the inside of the bin wall and a second side flange 83 spaced from the bin wall (see FIG. 7). Upper portions of the second flange 83 and the web 79 are cut away for providing a shoulder 85 on which the track 55 is supported, the space between the track 55 and the portion of the web 79 above the shoulder 85 being sufficient to allow the wheels 53 to roll on the track past the support 77.

Figure 8:
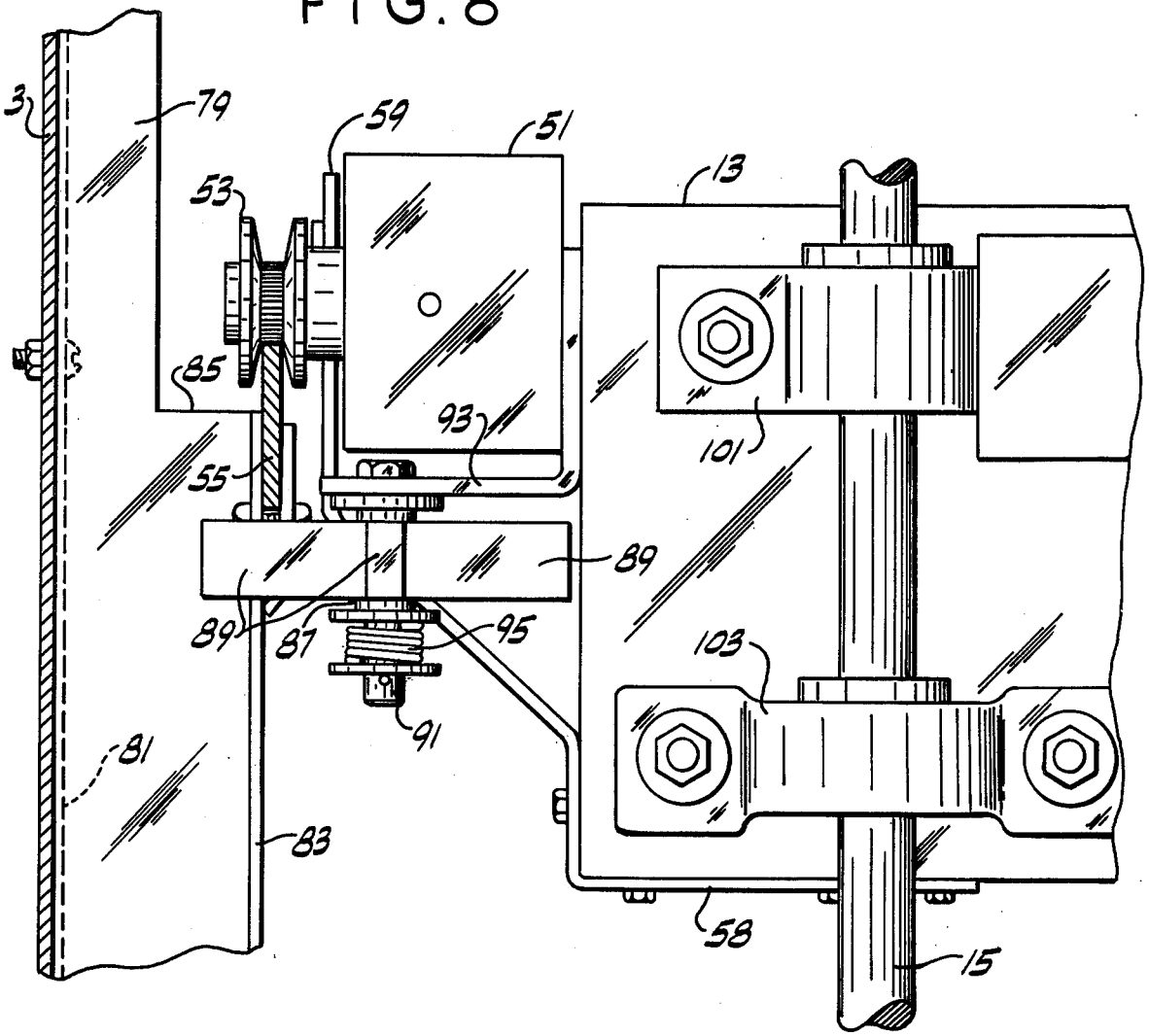
FIG. 8 is an enlarged fragment of FIG. 1, showing a locking means for holding wheels of the drive means on a track.
Figures 9A, 9B, 9C:
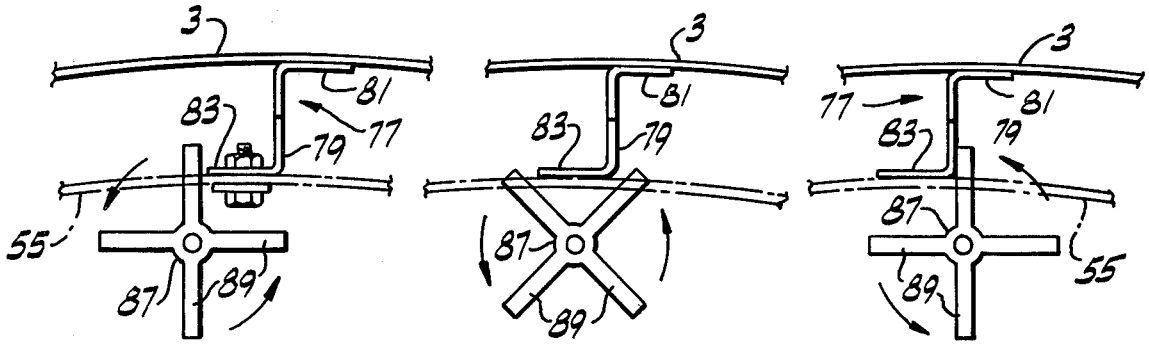
FIGS. 9A–9C are views illustrating the movement of the aforesaid locking means past a track support.

Mounted on the underside of the carriage 51 for holding the carriage wheels 53 down on the track 55 as the carriage drives the beam 13 around the vertical axis of the bin, is a locking means comprising a star wheel 87, the latter having a number of radial arms (e.g., four arms), each designated 89, and being rotatable about a generally vertical axis on a pin 91 extending down from a mounting plate 93 on the underside of the carriage 51. The star wheel 87 is shown in FIG. 8 in a locking position in which one of the arms 89 extends out from the carriage under the track 55 closely adjacent the bottom of the track thereby to prevent the wheels 53 from jumping off the track. As the carriage 51 moves along the track, the arm 89 is adapted to engage the edge of flange 83 of a track support 77, whereupon the arm rotates clear of the support and another arm is brought under the track (see FIGS. 9A–9C), the star wheel 89 thus reassuming a locking position until it engages the next support 77. A coil compression spring 95 on the lower end of pin 61 reacts from the bottom of the star wheel and constitutes means for braking the spin of the star wheel after it has rotated clear of a support thereby to ensure that the wheel remains in its locking position.

Each of the augers 15 is journaled in bearing means shown in FIGS. 8 and 10 to comprise upper and lower bearings 101 and 103, respectively, mounted on the face plate 25 of the beam 13. The upper bearing is primarily a thrust bearing (such as a double-row, tapered roller bearing) and the lower bearing is primarily a radial bearing (a ball bearing, for example). These bearings 101 and 103 support the auger shaft and allow it to rotate about its own axis for stirring the grain. Preferably, the upper and lower bearings are spaced relatively far apart on the beam for increasing bearing life. It is also desirable that the bearings be of nylon material.

Figure 2:
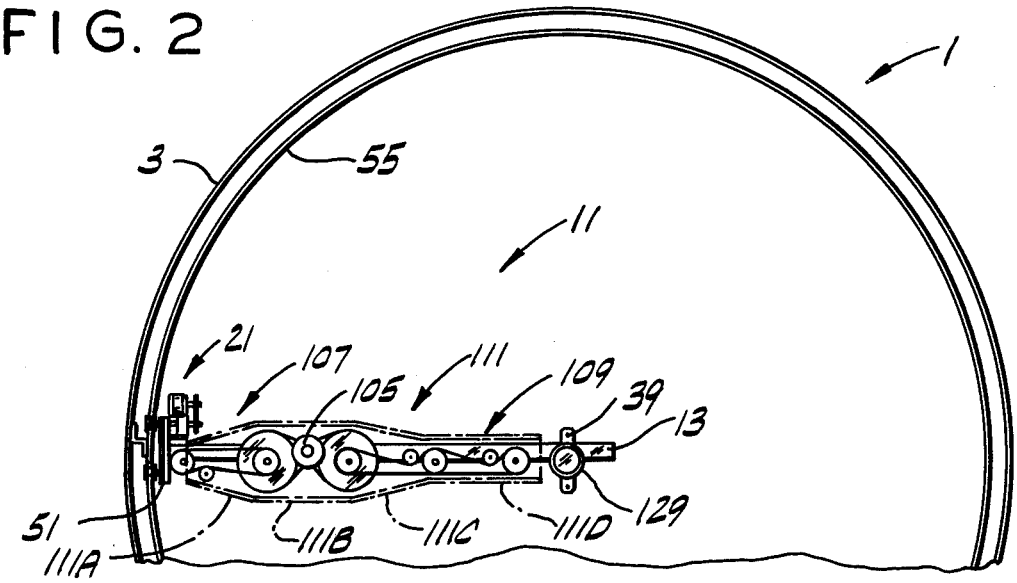
FIG. 2 is a plan of FIG. 1 showing the cover in phantom.

As illustrated in FIGS. 1 and 10, the upper ends of the augers 15 extend up above the top of the beam 13 and are adapted to be rotatably driven by the means 17 carried atop the beam 13. This means 17 comprises an electric motor 105 on the beam 13 between the ends of the beam, a first drive means 107 from the motor to the upper ends of the augers 15 between the motor and the outer (left) end of the beam, and a second drive means 109 from the motor to the upper ends of the augers between the motor and the suspending means 27. These two drive means may be of any suitable type, such as the belt and pulley systems shown in FIG. 2.

Figure 4:
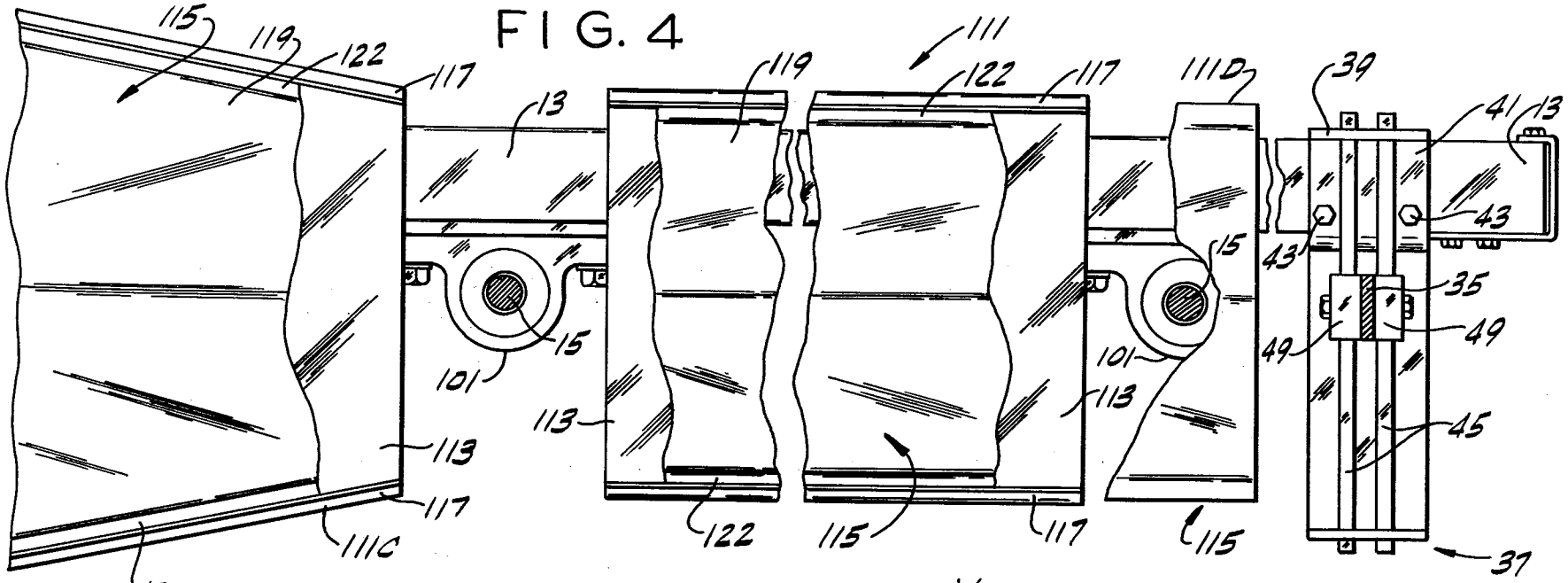
FIG. 4 is an enlarged horizontal section on line 4—4 of FIG. 1 with portions of the cover broken away.

Means indicated generally at 111 is provided for enclosing the drive means 107 and 109. As shown best in FIGS. 1 and 10, this enclosure means is divided into a series of sections 111A, 111B, 111C and 111D, each section comprising a bottom plate or panel 113 secured to the top of the beam, and a cover or hood, generally designated 115, for covering the drive means. Each bottom panel has upwardly extending, inwardly angled lips 117 at opposite sides thereof extending lengthwise of the beam. Each hood 115 is generally of inverted U-shape in transverse section, having a top 119 and downwardly extending sides 121. These sides 121 have flared lower margins 122 and are adapted to be sprung (squeezed) in and allowed to spring out for engagement of margins 122 with the lips 117 of the bottom panel 113 thereby to secure the hood to the panel, the lips thus constituting detent means. The bottom panels of sections 111A, 111B, 111C and 111D are spaced apart a suitable distance for allowing the augers 15 to extend up above the beam 13 (see FIG. 4). Brackets 123 are spaced along the beam and extend laterally outwardly therefrom for supporting the panels 113 on the beam. The plates and covers should be of sufficient strength to support a person walking or sitting thereon.

The enclosure of drive means 107 and 109 by the bottom panels 113 and the hoods 115 reduces the possibility of injury to those working near the drive means. Moreover, the hoods provide a walkway along the top of the beam for servicing the stirring apparatus 11. The hoods are, however, readily removable (by simply squeezing the hood sides 121 together and lifting the hoods 115 from the bottom panels 113) for permitting easy access to the drive means.

As shown in FIG. 5, the electric motor 56 on the carriage is also enclosed for safety purposes by a bottom panel 125 and a hood 127 similar to those described above.

The carriage motor 56 and auger motor 105 are supplied with electric current from any suitable electric source via a distributor 129 at the inner end of the beam 13 and suitable conductors in a conduit 131 extending from the distributor down along the center pivot bar 35 and toward the outer end of the beam to connections with the motors 56 and 105.

Each auger 15 is continuously rotated by the auger motor 105 about its vertical axis in the direction for augering grain upward. Thus, when the carriage motor 56 is energized to drive the carriage wheels 53 to cause the beam 13 to sweep around the bin about the vertical axis of the double-arm connector 31 (i.e., the vertical axis of the bin), the grain in the bin is blended from the bottom to the top of the bin. The blending is gentle so that the grain (e.g., kernels of corn) is not damaged. The stirring enables columns of hot air to pass upward entirely through the mass of grain for rapid drying, with even drying of the grain throughout its mass.

In view of the above, it will be seen that the several objects of the invention and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for stirring a mass of grain stored in a bin, the bin having a cylindrical wall and a roof, and a track extending in a circle around the inside of the wall in a generally horizontal plane above the level of grain in the bin, the track being mounted on supports spaced at intervals around the inside of the wall, said apparatus comprising a beam;

means for mounting the beam for swinging in a generally horizontal plane above the grain about the vertical central axis of the bin, said beam mounting means comprising means for suspending the beam from the roof of the bin adjacent one end of the beam constituting its inner end and providing a pivot for the beam to swing around the bin generally on its said vertical central axis, the beam extending out from said suspending means toward the bin wall, a carriage at the other end of the beam constituting its outer end, and wheels on the carriage adapted to roll on said track;

an electric motor carried by the carriage;

a drive from said electric motor to at least one of said wheels for driving the carriage around the track thereby to swing the beam around said central vertical axis;

a plurality of augers carried by the beam extending down from the beam at spaced intervals along the length of the beam;

a plurality of bearing means, one for each auger, mounted on one side of the beam, the upper ends of the augers extending up above the top of the beam;

a second electric motor carried by the beam at a location between the ends of the beam;

a first drive means from said second motor to the upper ends of the augers which are between said second motor and the outer end of the beam;

a second drive means from said second motor to the upper ends of the augers which are between said second motor and said suspending means;

a retainer for the carriage carried by the beam spaced outwardly from the outer end of the beam; the carriage comprising an elongate body extending transversely with respect to the beam between the outer end of the beam and said retainer;

and a pin mounted at the outer end of the beam for sliding movement axially of the pin and in the direction of the length of the beam from an extended position in which it extends out from the end of the beam through said carriage and into a hole in the retainer, to a retracted position in which the pin is retracted from the carriage for removal of the carriage from the beam.

2. Apparatus as set forth in claim 1 wherein means is provided for holding said pin in its extended position.

3. Apparatus as set forth in claim 2 wherein the beam is a box beam and said pin is mounted inside said beam and extends outwardly therefrom through a hole in the beam.

4. Apparatus as set forth in claim 3 wherein a crossbar extends from the inner end of the pin out through a slot in the side of the beam for sliding the pin between said extended and retracted positions, and said holding means comprises means for locking the crossbar in position in the slot when the pin is in said extended position.

5. Apparatus as set forth in claim 1 wherein said retainer comprises means having a portion extending out from the outer end of the beam and an upwardly extending outboard portion for receiving said pin in its extended position.

6. Apparatus for stirring a mass of grain stored in a bin, the bin having a cylindrical wall and a roof, and a track extending in a circle around the inside of the wall in a generally horizontal plane above the level of grain in the bin, the track being mounted on supports spaced at intervals around the inside of the wall, said apparatus comprising a beam;

means for mounting the beam for swinging in a generally horizontal plane above the grain about the vertical central axis of the bin, said beam mounting means comprising means for suspending the beam from the roof of the bin adjacent one end of the beam constituting its inner end and providing a pivot for the beam to swing around the bin generally on its said vertical central axis, the beam extending out from said suspending means toward the bin wall, a carriage at the other end of the beam constituting its outer end, and wheels on the carriage adapted to roll on said track;

an electric motor carried by the carriage;

a drive from said electric motor to at least one of said wheels for driving the carriage around the track thereby to swing the beam around said central vertical axis;

a plurality of augers carried by the beam extending down from the beam at spaced intervals along the length of the beam;

a plurality of bearing means, one for each auger, mounted on one side of the beam, the upper ends of the augers extending up above the top of the beam;

a second electric motor carried by the beam at a location between the ends of the beam;

a first drive means from said second motor to the upper ends of the augers which are between said second motor and the outer end of the beam;

a second drive means from said second motor to the upper ends of the augers which are between said second motor and said suspending means; and locking means carried by the carriage for holding the carriage wheels down on the track, said locking means extending under the track closely adjacent the bottom of the track and being movable upon engagement with said track supports to pass by each said support and then reassume a locking position until it engages the next support.

7. Apparatus as set forth in claim 6 wherein the locking means comprises a member rotatable on a generally vertical axis on the carriage having radial arms, each of which is adapted to extend out from the carriage under the track and to be engageable with a track support as the carriage moves along the track to rotate clear of the support and to bring another arm under the track.

8. Apparatus as set forth in claim 7 wherein said locking means further includes means for braking the rotation of said member about its vertical axis.

9. Apparatus for stirring a mass of grain stored in a bin, the bin having a cylindrical wall and a roof, and a track extending in a circle around the inside of the wall in a generally horizontal plane above the level of grain in the bin, the track being mounted on supports spaced at intervals around the inside of the wall, said apparatus comprising a beam;

means for mounting the beam for swinging in a generally horizontal plane above the grain about the vertical central axis of the bin, said beam mounting means comprising means for suspending the beam from the roof of the bin adjacent one end of the beam constituting its inner end and providing a pivot for the beam to swing around the bin generally on its said vertical central axis, the beam extending out from said suspending means toward the bin wall, a carriage at the other end of the beam constituting it outer end, and wheels on the carriage adapted to roll on said track;

an electric motor carried by the carriage;

a drive from said electric motor to at least one of said wheels for driving the carriage around the track thereby to swing the beam around said central vertical axis;

a plurality of augers carried by the beam extending down from the beam at spaced intervals along the length of the beam;

a plurality of bearing means, one for each auger, mounted on one side of the beam, the upper ends of the augers extending up above the top of the beam;

a second electric motor carried by the beam at a location between the ends of the beam;

a first drive means from said second motor to the upper ends of the augers which are between said second motor and the outer end of the beam;

a second drive means from said second motor to the upper ends of the augers which are between said second motor and said suspending means;

said track supports each comprising a vertical bar on the bin wall with said track being mounted on the outside of the bar and spaced from the bin wall, said bar having a recess at the side thereof away from the bin wall extending down from its upper end and providing a shoulder at the lower end of the recess on which the track is supported.

10. Apparatus as set forth in claim 9 wherein said bar is of Z-section having a web, a first side flange secured to the bin wall, and a second side flange having said track mounted thereon, said second flange and a portion of the web being cut away for providing said shoulder.

11. Apparatus for stirring a mass of grain stored in a bin, the bin having a cylindrical wall and a roof, and a track extending in a circle around the inside of the wall in a generally horizontal plane above the level of grain in the bin, the track being mounted on supports spaced at intervals around the inside of the wall, said apparatus comprising a beam;

means for mounting the beam for swinging in a generally horizontal plane above the grain about the vertical central axis of the bin, said beam mounting means comprising means for suspending the beam from the roof of the bin adjacent one end of the beam constituting its inner end and providing a pivot for the beam to swing around the bin generally on its said vertical central axis, the beam extending out from said suspending means toward the bin wall, a carriage at the other end of the beam constituting its outer end, and wheels on the carriage adapted to roll on said track;

an electric motor carried by the carriage;

a drive from said electric motor to at least one of said wheels for driving the carriage around the track thereby to swing the beam around said central vertical axis;

a plurality of augers carried by the beam extending down from the beam at spaced intervals along the length of the beam;

a plurality of bearing means, one for each auger, mounted on one side of the beam, the upper ends of the augers extending up above the top of the beam;

a second electric motor carried by the beam at a location between the ends of the beam;

a first drive means from said second motor to the upper ends of the augers which are between said second motor and the outer end of the beam;

a second drive means from said second motor to the upper ends of the augers which are between said second motor and said suspending means;

plate means on the beam; and a cover for the drive means having downwardly extending sides adapted to be sprung, the lower ends of said sides being engageable with the plate means for fastening the cover to the plate means by springing the sides of the cover.

12. Apparatus as set forth in claim 11 wherein said plate means has detent means thereon and the cover sides are adapted to be sprung in and then allowed to spring out into engagement with the detent means to fasten the cover to the plate means.

13. Apparatus as set forth in claim 12 wherein said detent means comprises inwardly angled lips at opposite sides of the plate means extending lengthwise of the beam.

14. Apparatus as set forth in claim 13 wherein said cover is generally U-shaped in cross-section with the lower ends of the cover sides being flared for springing out flush against said lips.

15. Apparatus as set forth in claim 14 having brackets spaced along said one side of the beam extending out from the beam to support said plate means.

16. Apparatus for stirring a mass of grain stored in a bin, the bin having a cylindrical wall and a roof, and a track extending in a circle around the inside of the wall in a generally horizontal plane above the level of grain in the bin, the track being mounted on supports spaced at intervals around the inside of the wall, said apparatus comprising a beam;

means for mounting the beam for swinging in a generally horizontal plane above the grain about the vertical central axis of the bin, said beam mounting means comprising means for suspending the beam from the roof of the bin adjacent one end of the beam constituting its inner end and providing a pivot for the beam to swing around the bin generally on its said vertical central axis, the beam extending out from said suspending means toward the bin wall, a carriage at the other end of the beam constituting its outer end, and wheels on the carriage adapted to roll on said track;

an electric motor carried by the carriage;

a drive from said electric motor to at least one of said wheels for driving the carriage around the track thereby to swing the beam around said central vertical axis;

a plurality of augers carried by the beam extending down from the beam at spaced intervals along the length of the beam;

a plurality of bearing means, one for each auger, mounted on one side of the beam, the upper ends of the augers extending up above the top of the beam;

a second electric motor carried by the beam at a location between the ends of the beam;

a first drive means from said second motor to the upper ends of the augers which are between said second motor and the outer end of the beam;

a second drive means from said second motor to the upper ends of the augers which are between said second motor and said suspending means;

the suspending means comprising a bearing, a suspension for suspending the bearing from the roof of the bin on the central vertical axis of the bin, a center pivot rotatably mounted in the bearing and carrying a hanger beneath the bearing for supporting the inner end of the beam above the grain, said beam being axially adjustable with respect to the hanger for varying the extension of the beam radially outwardly from the hanger, said hanger and beam also being relatively adjustable transversely with respect to the beam.

17. Apparatus as set forth in claim 16 wherein said hanger comprises a cradle for cradling the beam with the beam being axially slidable in the cradle for adjusting said extension of the beam, said cradle including a horizontal member extending generally transversely of the beam, above the beam, said member being carried by the pivot and being adjustable with respect to the pivot.

18. Apparatus for stirring a mass of grain stored in a bin, the bin having a cylindrical wall and a roof, and a track extending in a circle around the inside of the wall in a generally horizontal plane above the level of grain in the bin, the track being mounted on supports spaced at intervals around the inside of the wall, said apparatus comprising a beam;

means for mounting the beam for swinging in a generally horizontal plane above the grain about the vertical central axis of the bin, said beam mounting means comprising means for suspending the beam from the roof of the bin adjacent one end of the beam constituting its inner end and providing a pivot for the beam to swing around the bin generally on its said vertical central axis, the beam extending out from said suspending means toward the bin wall, a carriage at the other end of the beam constituting its outer end, and wheels on the carriage adapted to roll on said track;

an electric motor carried by the carriage;

a drive from said electric motor to at least one of said wheels for driving the carriage around the track thereby to swing the beam around said central vertical axis;

a plurality of augers carried by the beam extending down from the beam at spaced intervals along the length of the beam;

a plurality of bearing means, one for each auger, mounted on one side of the beam, the upper ends of the augers extending up above the top of the beam;

a second electric motor carried by the beam at a location between the ends of the beam;

a first drive means from said second motor to the upper ends of the augers which are between said second motor and the outer end of the beam;

a second drive means from said second motor to the upper ends of the augers which are between said second motor and said suspending means; said beam being a hollow box-beam comprising a channel and a face plate removably secured to the channel at the open side thereof constituting said one side of the beam.

* * * * *